US005649591A

United States Patent [19]

Green

[11] Patent Number: 5,649,591

[45] Date of Patent: Jul. 22, 1997

[54] RADIATOR CAP WITH SACRIFICIAL ANODE

[76] Inventor: Michael Philip Green, 302 Cortsen Rd., Pleasant Hill, Calif. 94523

[21] Appl. No.: 621,337

[22] Filed: Mar. 25, 1996

Related U.S. Application Data

[63] Continuation of Ser. No. 375,682, Jan. 20, 1995.

[51] Int. Cl.[6] ..... F28F 19/00

[52] U.S. Cl. ..... 165/134.1; 220/DIG. 32; 220/212

[58] Field of Search ..... 220/212, DIG. 32; 165/134.1

[56] References Cited

U.S. PATENT DOCUMENTS

| | | | |
|---|---|---|---|
| 3,071,285 | 1/1963 | Friend | 220/DIG. 33 |
| 4,035,903 | 7/1977 | Taggart | 29/458 |
| 4,051,007 | 9/1977 | Hossle | 204/197 |
| 4,185,751 | 1/1980 | Moore et al. | 220/DIG. 32 X |
| 4,241,845 | 12/1980 | Daly et al. | 220/DIG. 32 X |
| 4,338,997 | 7/1982 | Krueger et al. | 165/134.1 |
| 4,347,895 | 9/1982 | Zambrow | 165/134.1 |
| 4,489,883 | 12/1984 | Anderson | 220/DIG. 32 X |
| 5,031,790 | 7/1991 | Keller | 220/89.4 X |
| 5,059,296 | 10/1991 | Sherman | 204/228 |
| 5,114,035 | 5/1992 | Brown | 220/DIG. 32 X |
| 5,127,433 | 7/1992 | Argyle et al. | 137/559 |
| 5,137,067 | 8/1992 | Espeut | 165/134.1 X |
| 5,148,862 | 9/1992 | Hashiura et al. | 165/134.1 |
| 5,181,558 | 1/1993 | Tsuda et al. | 165/134.1 X |
| 5,289,872 | 3/1994 | Kent | 165/134.1 X |
| 5,465,783 | 11/1995 | O'Connor | 165/134.1 |

*Primary Examiner*—Allan N. Shoap
*Assistant Examiner*—Robin A. Hylton
*Attorney, Agent, or Firm*—Dergosits & Noah LLP

[57] ABSTRACT

A radiator cap having an integral sacrificial anode inhibits corrosion of metal within the radiator. The radiator cap is placed on the opening of the radiator thereby immersing the sacrificial anode in coolant fluid contained within the radiator. The sacrificial anode is preferentially oxidized, thus providing cathodic protection. The radiator cap is easily removable and allows efficient monitoring of the condition of the sacrificial anode. When the sacrificial anode is depleted it is easily replaced to provide a fresh sacrificial anode.

6 Claims, 2 Drawing Sheets

RADIATOR CAP WITH SACRIFICIAL ANODE

This is a continuation of co-pending application Ser. No. 08/375,682 filed on Jan. 20, 1995.

BACKGROUND OF THE INVENTION

1. Field of the Invention

The present invention relates to automobile radiators and engines and preventing corrosion in the cooling system especially those with components of dissimilar metal construction. (Engines with alumina heads and iron blocks and steel radiators, engines of all aluminum construction with steel radiators and engines of iron construction with radiators of aluminum construction.) It is these types of combinations that present the most problems regarding cooling system corrosion.

2. Description of Related Art

Automobile cooling systems use water and coolant/antifreeze liquids circulated through the water jackets of the engine, heads and water pump to effect heat transfer. Then the hot liquid is piped back to the radiator/storage tank which is a liquid to air heat exchanger. A typical radiator is made up of a storage tank either above or to the side of the cooling tubes and exchanged cooling fins. This storage tank has an opening to the interior of the storage tank part, a core of cooling tubes which is where the coolant liquid flows and connected to these cooling tubes are fins which transfer heat to the air which is pulled or pushed through the fins and around the tubes for heat transfer from the coolant to the air passing through.

Radiators and engines were historically made of iron and steel which as similar metals had little corrosion caused by electrolytic activity. Any engine/head/radiator combination of dissimilar metals is very vulnerable to corrosion because of this electrolytic activity. In such cases the aluminum components corrode and become porous and may begin to leak in as little as 12 to 24 months.

It is the electrolytic activity, where one of the metals act as an anode and corrodes and other metals act as a cathode and do not corrode. Consequently, corrosion inhibitors have been developed to prevent corrosion. Chemical corrosion inhibitors can inhibit electrolysis, but are toxic, present problems to the environment and problems of disposal.

Sacrificial anodes, constructed of magnesium, aluminum, zinc or combinations thereof have also been used as corrosion inhibitors. U.S. Pat. No. 5,292,595 describes a sacrificial anode of specified composition bonded to the core metal to prevent the occurrence of pitting corrosion of core material in a heat exchanger such as a radiator or heater core.

Unfortunately such an anode is hard to access to check its condition or replace it when it wears out. A need exists for a corrosion inhibiting sacrificial anode which is easily accessible. Since a sacrificial anode is designed to be consumed, easy accessibility would allow verification of its effective working status and efficient replacement when depleted.

SUMMARY OF THE INVENTION

A radiator cap is provided which includes a handle portion, a sealing gasket portion and a sacrificial anode to inhibit corrosion of automobile engine components and radiators/heater cores. In one aspect, the radiator cap includes a first gasket adjacent to the handle portion and a second gasket which is coaxial with and is spring loaded in relation to the first gasket. A sacrificial anode mounting post is attached coaxially to the second gasket sealing area.

DETAILED DESCRIPTION OF THE INVENTION

In accordance with the present invention, a radiator cap contains an integral sacrificial anode that inhibits corrosion of metal components of the radiator. Placement of the sacrificial anode on the radiator cap allows for convenient verification of the condition of the sacrificial anode. Moreover, a worn out sacrificial anode is easily replaced by either changing the entire radiator cap or by merely replacing the sacrificial anode.

Figure 1:
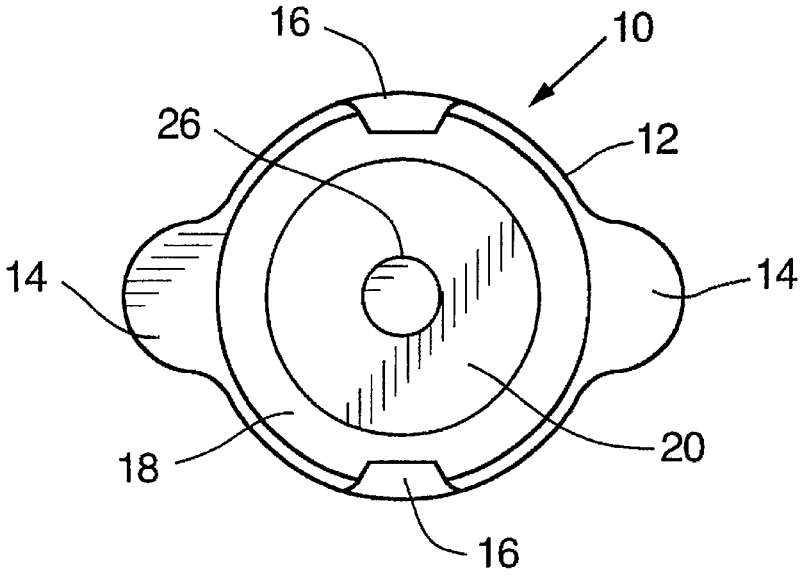
FIG. 1 is a top view of a radiator cap according to the present invention.
Figure 2:
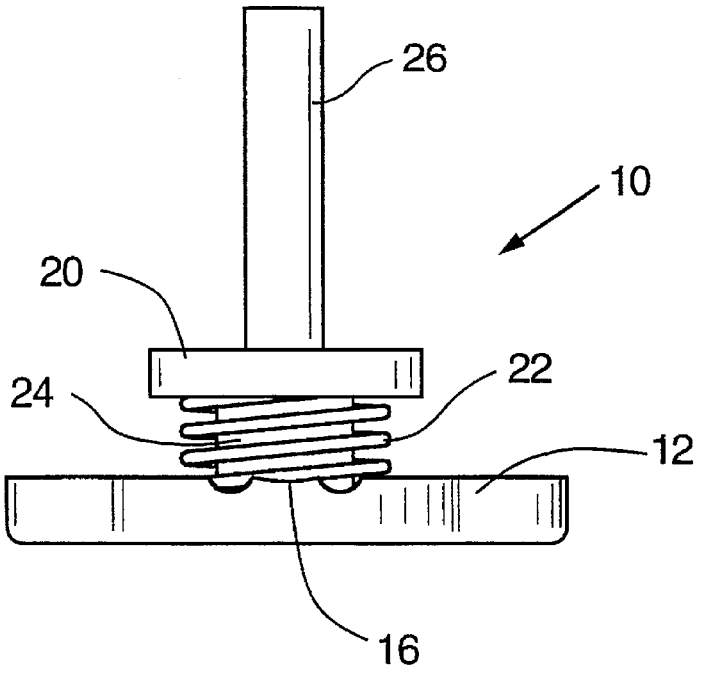
FIG. 2 is a side view of the radiator cap shown in FIG. 1.

A radiator cap having a sacrificial anode according to the present invention is illustrated in FIGS. 1 and 2. The radiator cap 10 includes a handle 12 with grips 14. Two lip catches 16, in distal relation to each other, are provided to engage the rim of the opening to a radiator. The radiator cap 10 includes a gasket portion which provides a water-tight seal. The gasket portion includes a first gasket 18 positioned adjacent the interior of the handle 12. A second gasket 20 is mounted under tension provided by a spring 22 and support shaft 24 coaxial with the first gasket 18. A sacrificial anode 26 is mounted coaxially onto the second gasket 20.

Figure 3:
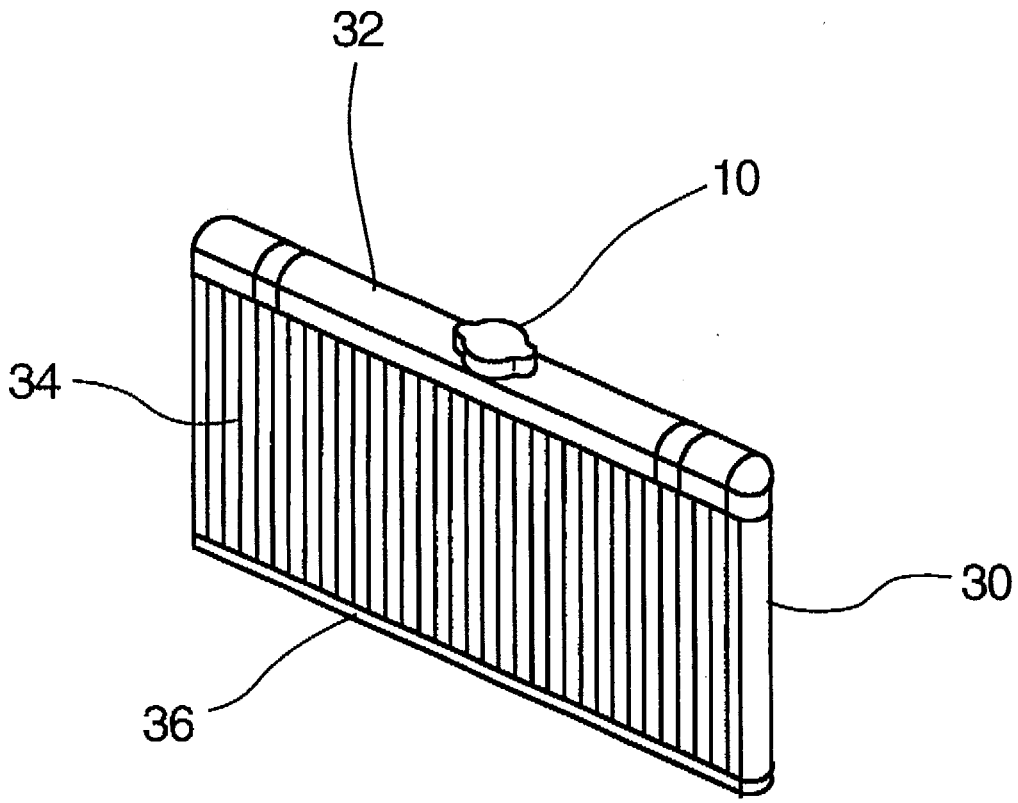
FIG. 3 is a perspective view of a radiator with a radiator cap according to the present invention.

In operation, the radiator cap 10 is adapted to seal the radiator and place the sacrificial anode 26 into the radiator's coolant fluid. Cathodic protection is provided by making the radiator components cathodic to the sacrificial anode and providing sufficient voltage between the two electrodes. The sacrificial anode 26 is slowly consumed during the protection process while generating an electrical current. Sacrificial anodes of zinc, magnesium, aluminum alloy or combinations thereof may provide the potential, or inert anodes such as graphite, stainless steel, or platinum coated titanium may be used with power supplied from a rectifier. Various sacrificial anodes are known in the art. Thus, the radiator cap 10 is placed over the opening to the radiator and closed, thereby inserting the sacrificial anode 26 into the coolant fluid contained in the radiator. FIG. 3 illustrates a radiator 30 and a radiator cap 10 according to the present invention. The radiator 30 includes an upper tank portion 32, a core portion 34 and a lower tank portion 36.

The sacrificial anode 26 may be checked periodically to see if it is reaching the end of its useful life. Indeed, placement of the sacrificial anode 26 directly onto the radiator cap 10 facilitates viewing at little or no cost. When the sacrificial anode 26 is depleted, the radiator cap 10 is simply replaced at nominal cost. Alternatively, the sacrificial anode 26 is made detachable and is removed from the radiator cap 10 when its useful life has expired. A new sacrificial anode 26 is then secured in place of the expired sacrificial anode 26. Various detachable securing devices such as snaps and screw assemblies are known in the art and are suitable for use in accordance with the present invention.

The above disclosure and examples should not be considered as limitations of the various embodiments and iterations of a radiator cap having an integral sacrificial anode. Modifications may be made by those with skill in the art to the embodiments described above. For example, various radiator caps are and have been used on all manner of motor vehicles that could be modified to receive a sacrificial anode as long as the anode is of sufficient length to be immersed in coolant fluid contained in the radiator. Likewise, any sacrificial anode known to those with skill in the art that is appropriately dimensioned and configured can be used in accordance with the present invention. While the gasket portion and the sacrificial anode are described above as being coaxial, it is contemplated that various other orientations and configurations may be assumed. Indeed, the sacrificial anode may be attached at any suitable point on the radiator cap and is not limited to being attached to a gasket. Furthermore, any radiator which is capable of receiving a radiator cap may be utilized in accordance with the present invention. Consequently, it is clear that modifications may be made by those with skill in the art that are within the following claims.

What is claimed is:

1. A radiator cap comprising:

a) a handle portion having an engaging means configured to engage a rim surrounding an opening of a radiator for securing the radiator cap to the radiator;

b) a gasket portion disposed below the handle portion and depending from the inner surface of the handle portion having a first gasket positioned adjacent to the handle portion and a second gasket spaced axially downward from the first gasket by a predetermined distance, wherein the gasket portion cooperates with the handle portion such that when the radiator cap is placed onto the rim surrounding the opening of the radiator, the first and second gaskets seat against different parts of upper and lower rims surrounding the opening of the radiator thereby providing a seal; and c) sacrificial anode for inhibiting erosion of the radiator and engine components, the sacrificial anode depending from an interior surface of the radiator cap and configured to extend from the interior surface of the radiator cap coaxial with and into the radiator, the sacrificial anode being only below the gasket portion second gasket such that the end of the sacrificial anode distal from the interior surface of the radiator cap is at least partially immersed in fluid contained in the radiator, whereby the radiator cap an be periodically removed from the radiator in order to monitor the state of the sacrificial anode.

2. A radiator cap according to claim 1 wherein the gasket portion includes a first gasket adjacent to and coaxial with the handle portion, a second gasket coaxial with and in spring loaded relation to said first gasket, and the sacrificial anode coaxially attached to the second gasket.

3. A radiator cap according to claim 1 wherein the sacrificial anode is detachably mounted to the radiator cap.

4. A radiator comprising:

a) an upper tank portion, a core portion, and a lower tank portion, the upper tank portion including an opening for receiving a radiator cap; and b) a radiator cap having i) a gasket portion with a first gasket and a second gasket spaced axially downward from the first gasket by a predetermined distance; and ii) an integral sacrificial anode configured to depend from an interior surface of the radiator cap the sacrificial anode being only below the gasket portion second gasket, and configured to extend into the radiator and be of sufficient length such that the end of the sacrificial anode distal from the interior surface of the radiator cap is at least partially immersed in fluid contained in the radiator, whereby the radiator cap with sacrificial anode can be periodically removed from the radiator in order to monitor the state of the sacrificial anode.

5. A method of inhibiting erosion in a radiator and engine components comprising the steps of:

a) providing a radiator cap with a gasket portion with a first gasket and second gasket spaced axially downward from the first gasket by a predetermined distance; and ii) an integral sacrificial anode configured to depend from an interior surface of the radiator cap, the sacrificial anode being only below the gasket portion second gasket, and configured to extend into the radiator and be of sufficient length such that the end of the sacrificial anode distal from the interior surface of the radiator cap is at least partially immersed in fluid contained in the radiator;

b) inserting the sacrificial anode into the radiator;

c) contacting the end of the sacrificial anode distal from the interior surface of the radiator cap with fluid contained in the radiator;

d) closing the radiator with the radiator cap; and e) allowing the sacrificial anode to be consumed during operation of the radiator whereby consumption of the sacrificial anode inhibits erosion of the radiator and engine components and further whereby the radiator cap can be periodically removed from the radiator in order to monitor the state of the sacrificial anode.

6. A method according to claim 5 further comprising periodically removing the radiator cap and monitoring the condition of the sacrificial anode.

* * * * *